US005653371A

United States Patent [19]

Hou

[11] Patent Number: 5,653,371

[45] Date of Patent: Aug. 5, 1997

[54] MAGAZINE FOR POWER NAIL GUNS

[76] Inventor: Chang Feng-Mei Hou, No. 52, Alley 17, Lane 20, Chung-Shan Road, Tai-Ping Hsiang, Taichung Hsien, Taiwan

[21] Appl. No.: 528,351

[22] Filed: Sep. 14, 1995

[51] Int. Cl.[6] ..... B25C 1/04

[52] U.S. Cl. ..... 227/109; 227/119; 227/120

[58] Field of Search ..... 227/109, 120, 227/135, 136, 119

[56] References Cited

U.S. PATENT DOCUMENTS

| | | | |
|---|---|---|---|
| 3,037,207 | 6/1962 | Pazan | 227/109 |
| 4,519,533 | 5/1985 | Jirovetz | 227/109 |
| 4,815,647 | 3/1989 | Chou | 227/109 |
| 5,096,109 | 3/1992 | Chen | 227/109 |
| 5,368,213 | 11/1994 | Massari, Jr. | 227/120 |
| 5,433,367 | 7/1995 | Liu | 227/120 |
| 5,522,533 | 6/1996 | Mukoyama et al. | 227/109 |

*Primary Examiner*—Scott A. Smith

*Attorney, Agent, or Firm*—Morton J. Rosenberg; David I. Klein

[57] ABSTRACT

A magazine having a first side plate and a second side plate connected in parallel between the nail nozzle and handle of a power nail gun for carrying a bar of nails in a longitudinal sliding space defined between the side plates, and a follower plate mounted in the longitudinal sliding space to push the loaded bar of nails toward the nail nozzle of the power nail gun, wherein the follower plate is supported on two compression springs, the compression springs being mounted in a respective chamber on the second side plate at different elevations, each compression spring having a front end connected to the follower plate and a rear end fixedly secured to one end of the second side plate remote from the nozzle plate.

3 Claims, 3 Drawing Sheets

MAGAZINE FOR POWER NAIL GUNS

BACKGROUND OF THE INVENTION

The present invention relates to magazines for power nail guns, and relates more particularly to such a magazine which has invisible compression springs on the inside to give a forward pressure to the follower plate, which pushes the bar of nails toward the nail nozzle of the power nail gun.

FIG. 1 shows a magazine for power nail guns according to the prior art. The magazine 1 comprises a horizontal top wall 13, a horizontal bottom wall 14, a nail loading space 15 defined between the top wall 13 and the bottom wall 14 for loading a bar of nails 16, a sliding door 11 moved between the top wall 13 and the bottom wall 14 at one side, and a follower plate 12 fixed to the sliding door 11, a spring (not shown) connected to the follower plate 12 to force it toward the nail nozzle 17. Because the pointed tips of the nails 16 are moved along a track on the bottom wall 14 toward the nail nozzle 17, the elevation difference between the bottom end of the nail nozzle 17 and the bottom wall 14 of the magazine 1 must be confined within a limited range, i.e., the length of the nail nozzle 17 is limited. That is, the user must use shortened nails in this kind of magazine. However, the application in the power nail is improper when the length of the nail nozzle 17 is shortened. FIG. 2 shows nails of different lengths 16 installed in the magazine 1, and the pointed tips of the nails 16 are maintained at the same elevation.

FIGS. 3 and 4 show another structure of magazine for power nail guns according to the prior art. The magazine 2 comprises a longitudinal sliding space 22 for loading a bar of nails 21 from the top side of the magazine 2, permitting the head of the bar of nails 21 to be supported above the longitudinal sliding space 22 and pushed by a follower plate 23 toward the nail nozzle 24. The follower plate 23 is pulled toward the nail nozzle 24 by a spiral coil spring 26, which is mounted outside the magazine 2. When the user pulls the follower plate 23, the user's hand tend to be injured by the sharp edge 26 of the spiral coil spring 25. When nails 21 of different lengths are installed, the heads of the nails 21 are supported outside the longitudinal sliding space 22, and the pointed tips of the nails 21 are spaced from the elevation of the bottom side of the nail nozzle 24 at different distances. Therefore, when short nails are used and installed in the longitudinal sliding space 22, they tend to displace.

SUMMARY OF THE INVENTION

The present invention has been accomplished to provide a magazine for power nail guns which eliminates the aforesaid drawbacks. According to one aspect of the present invention, the magazine comprises a first side plate and a second side plate connected in parallel between the nail nozzle and handle of a power nail gun for carrying a bar of nails in a longitudinal sliding space defined between the side plates, and a follower plate mounted in the longitudinal sliding space to push the loaded bar of nails toward the nail nozzle of the power nail gun, wherein the first side plate has a nail loading port for loading a bar of nails in the longitudinal sliding space from one side; the follower plate is supported on two compression springs, the compression springs being mounted in a respective chamber on the second side plate at different elevations, each compression spring having a front end connected to the follower plate and a rear end fixedly secured to one end of the second side plate remote from the nozzle plate.

According to another aspect of the present invention, the first side plate has a retaining groove for engagement with a front retainer rod on the follower plate to hold the follower plate in place when the compression springs are compressed.

DETAILED DESCRIPTION OF THE PREFERRED EMBODIMENT

Figure 1:
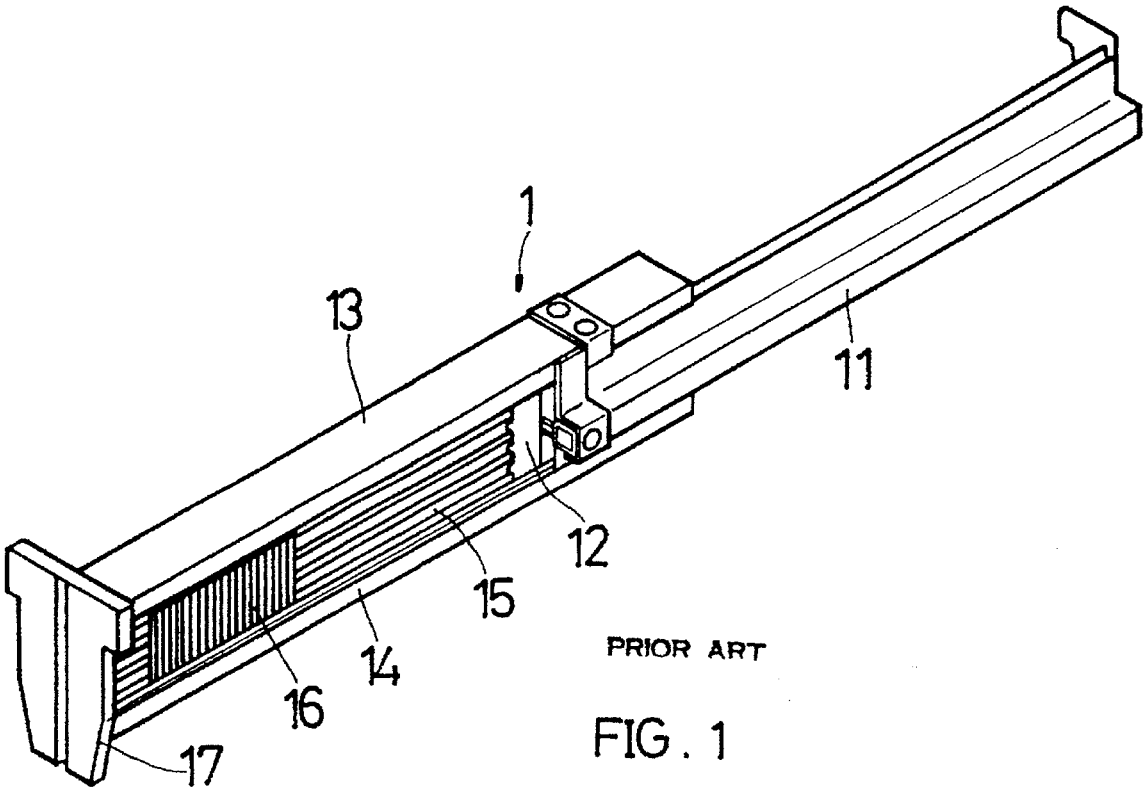
PRIOR ART FIG. 1
FIG. 1 shows a magazine for power nail guns according to the prior art.
Figure 2:
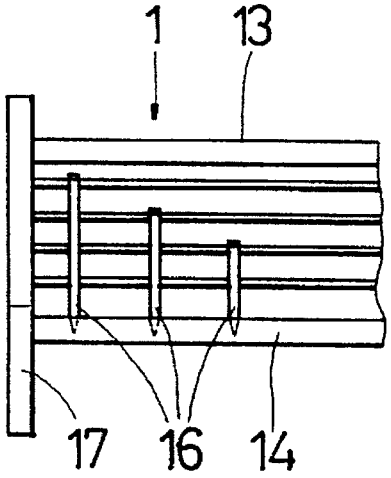
PRIOR ART FIG. 2
FIG. 2 shows nails of different lengths installed in the magazine shown in FIG. 1.
Figure 3:
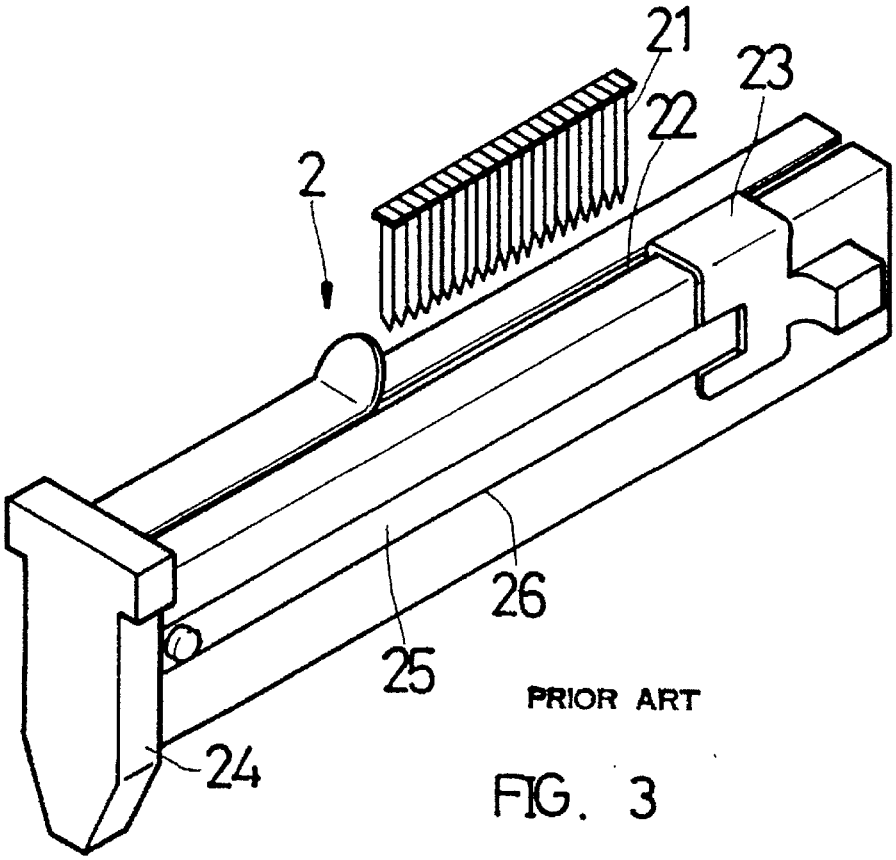
PRIOR ART FIG. 3
FIG. 3 shows another structure of magazine for power nail guns according to the prior art.
Figure 4:
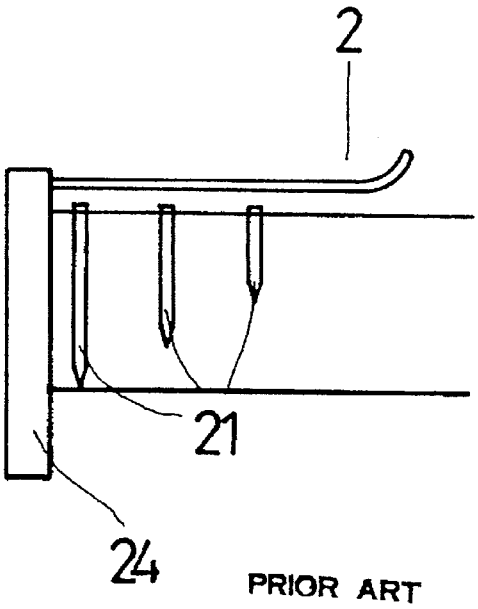
PRIOR ART FIG. 4
FIG. 4 shows nails of different lengths installed in the magazine shown in FIG. 3.
Figure 5:
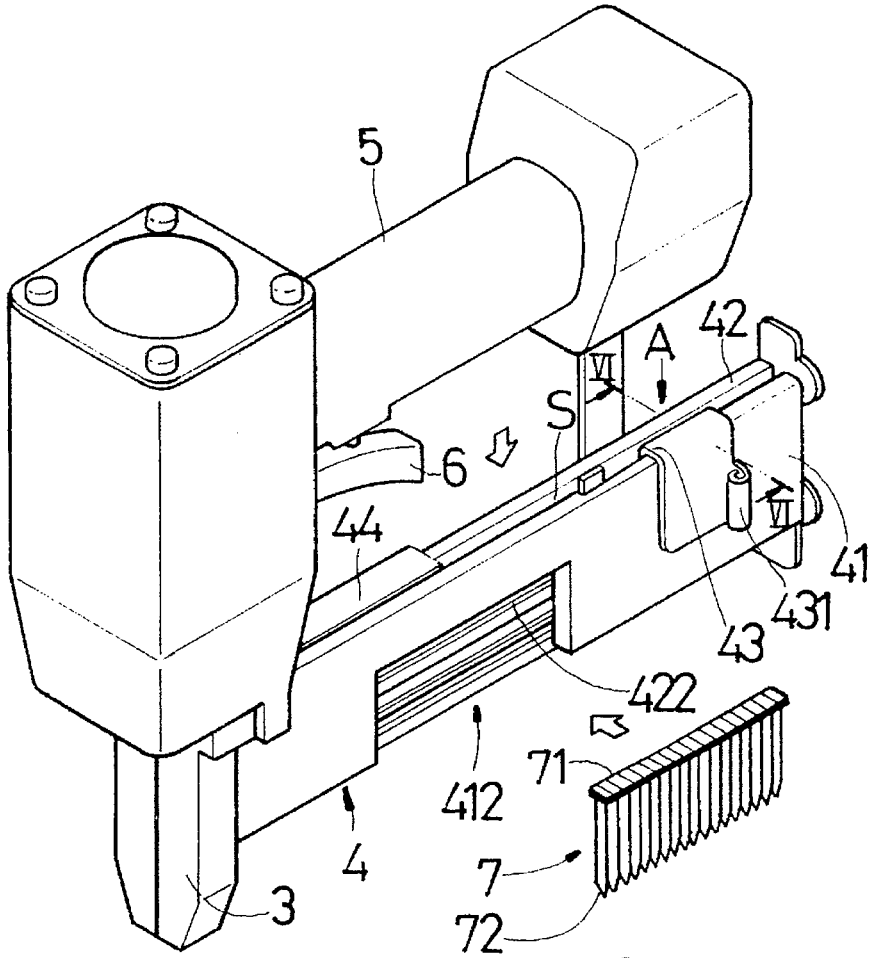
FIG. 5 shows a magazine installed in a power nail gun according to the present invention.

Referring to FIG. 5, the magazine, referenced by 4, comprises a first side plate 41 and a second side plate 42. The front end of the magazine 4 is fastened to the nail nozzle, referenced by 3, below the trigger, referenced by 6. The rear end of the magazine 4 is fixedly secured to the handle, referenced by 5. A narrow sliding space S is defined between the inside wall 411 of the first side plate 41 and the inside wall 421 of the second side plate 42 for the sliding of a bar of nails 7. A follower plate 43 is mounted in the narrow sliding space S to push the bar of nails 7 toward the nail nozzle 3, having a handle 431 disposed outside the first side plate 41. The magazine 4 further comprises a fender 44 at the top side to stop the bar of nails 7 from escaping out of the narrow space S.

Figure 6:
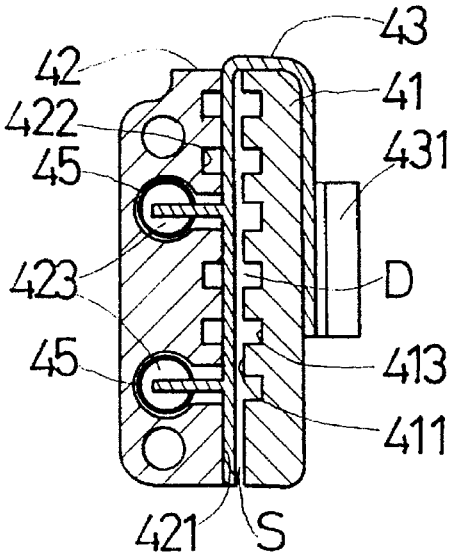
FIG. 6 is a sectional view taken along line VI—VI of FIG. 5.

Referring to FIG. 6, a nail loading port 412 is made on the first side plate 41, and at least one pair of parallel grooves 413 and 422 is symmetrically and longitudinally made on the inside walls 411 and 421 of the side plates 41 and 42. Each pair of parallel grooves 413 and 422 define a space D across the narrow sliding space S for receiving the head 71 of the bar of nails 7. The follower plate 43 is supported on two parallel compression springs 45. The compression springs 45 are mounted in a respective chamber 423 in the second side plate 42 at different elevations, each having a front end connected to the follower plate 43 and a rear end fixed to the rear end of the second side plate 42.

Figure 7:
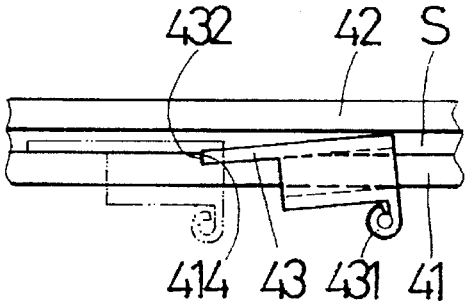
FIG. 7 is a partial view taken in the direction "A" of FIG. 5.

Referring to FIG. 7, the first side plate 41 has a retaining groove 414 on the inside wall 411 near the rear end. When the follower plate 43 is pulled backwards toward the rear end of the magazine 4 to compress the compression springs 45, the front retainer rod 432 of the follower plate 43 will engage the retaining groove 414. When the front retainer rod 432 of the follower plate 43 engages the retaining groove 414, the follower plate 43 is retained in place for allowing a bar of nails 7 to be inserted through the nail loading port 412 and loaded in one parallel grooves 413 and 422.

Referring to FIGS. 5, 6, and 7 again, through the handle 431, the follower plate 43 is pulled backwards along the inside wall 411 of the first side plate 41 to compress the compression springs 45 and then retained to the retaining groove 414. Then, a bar of nails 7 is inserted through the nail loading port 412 and then loaded into place, permitting the head 71 of the bar of nails 7 to be mounted in one pair of parallel grooves 413 and 422 and the shanks 72 of the nails of the bar of nails 7 to be suspended in the narrow sliding space S. When the bar of nail 7 is installed, the follower plate 43 moved away from the retaining groove 414. When the front retainer rod 432 of the follower plate 43 is released from the retaining groove 414, the follower plate 43 is pushed forwards by the compression springs 45 for force the bar of nails 7 into the nail nozzles 3.

Thus, the present invention solves the following problems and disadvantages:

1. The bent or hit problem. Because the length of the sliding door 11 of the prior is too long, the door 11 tends to be bent or hit when nails are installed.
2. Work place limitation. Due to the sliding door 11, there must be the horizontal top wall and bottom wall 13, 14; so that the nail nozzle is too short and it is not suitable to work at a deep recess or a deep groove area.
3. The injury possibility. The user's hand tends to be injured by the sharp edge 26 of the spiral coil spring 25 of another prior art.
4. The displace disadvantages. In another prior art, when short nails are used and installed in the longitudinal sliding space 22, they tend to displace.

It is to be understood that the drawings are designed for purposes of illustration only, and are not intended as a definition of the limits and scope of the invention disclosed.

I claim:

1. A magazine comprised of a first side plate and a second side plate fixedly connected together in spaced parallel relationship between a nail nozzle and a handle of a power nail gun for defining a longitudinal sliding space therebetween to carry a bar of nails therein, said sliding space being open at a lower end of said magazine for extension of a portion of the nails therethrough, and a follower plate mounted in said longitudinal sliding space to push a bar of nails loaded therein toward the nail nozzle of the power nail gun, wherein said follower plate is supported on two compression springs, each of said two compression springs being mounted in a respective chamber formed in said second side plate at different elevations, each compression spring having a front end connected to said follower plate and a rear end fixedly secured to one end of said second side plate remote from the nail nozzle.

2. The magazine of claim 1 where said first side plate has a nail loading port formed therethrough through which the bar of nails is loaded into said longitudinal sliding space, and at least one pair of parallel grooves longitudinally and symmetrically made on said first side plate and said second side plate for receiving respective head portions of the loaded bar of nails.

3. The magazine of claim 2 where said first side plate has a retaining groove formed in an inner surface thereof adjacent a rear end of said nail loading port for engagement by a portion of said following plate to maintain said follower plate clear of said nail loading port.

* * * * *